United States Patent [19]

O'Sullivan

[11] 3,952,357

[45] Apr. 27, 1976

[54] SHOE STRETCHING DEVICE

[76] Inventor: Bernard O'Sullivan, 120-31 DeKruif Place, Bronx, N.Y. 10475

[22] Filed: Jan. 30, 1975

[21] Appl. No.: 545,335

[52] U.S. Cl. ..... 12/115.2
[51] Int. Cl.[2] ..... A43D 5/00
[58] Field of Search ..... 12/115.2, 115.4, 114.2

[56] References Cited

UNITED STATES PATENTS

| | | | |
|---|---|---|---|
| 1,289,927 | 12/1918 | Schevitz | 12/115.2 |
| 1,453,608 | 5/1923 | Sprague | 12/115.2 |
| 2,714,217 | 8/1955 | Dore | 12/115.2 |

*Primary Examiner*—Patrick D. Lawson
*Attorney, Agent, or Firm*—Daniel Jay Tick

[57] ABSTRACT

A pair of stretching members each shaped to stretch a concave area in a side of a shoe to relieve pressure on a corn, bunion, and the like, are selectively moved into and away from corresponding sides of a shoe for stretching the sides to desired extents.

2 Claims, 5 Drawing Figures

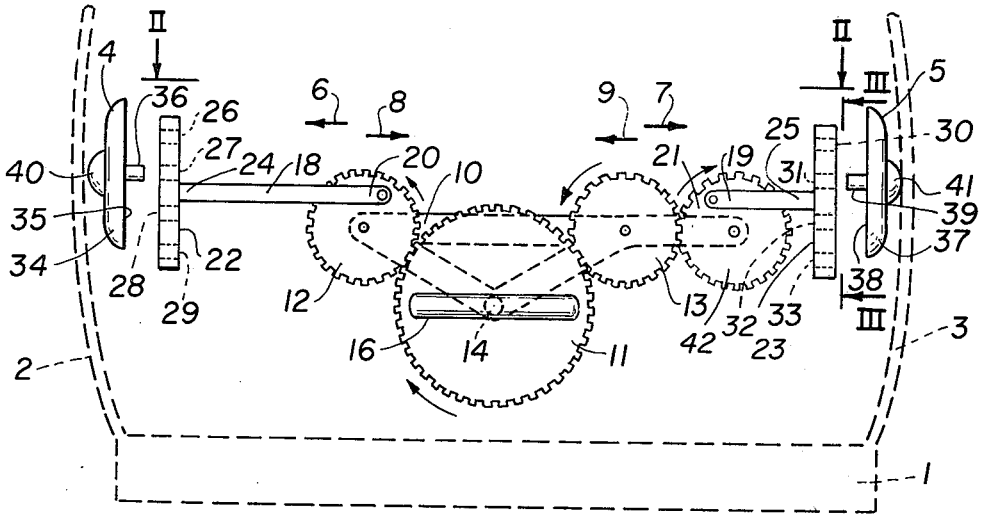
FIG. 1
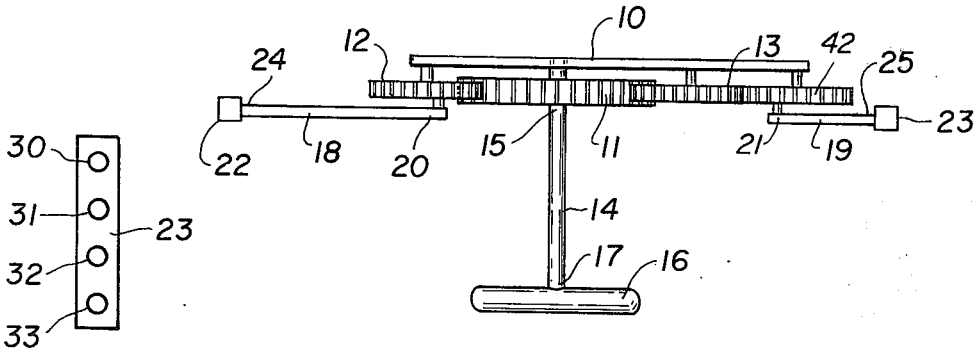
FIG. 2
FIG. 3
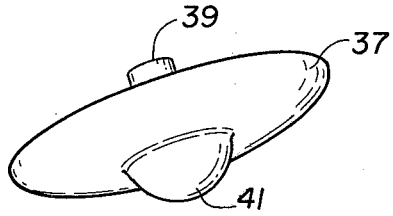
FIG. 4
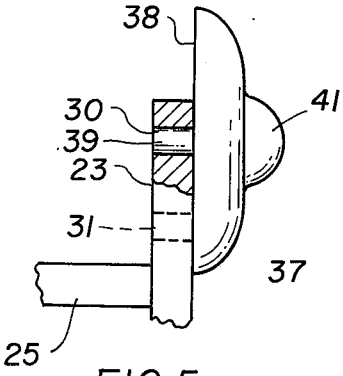
FIG. 5

SHOE STRETCHING DEVICE

BACKGROUND OF THE INVENTION

The present invention relates to a shoe sretching device. More particularly, the invention relates to a shoe stretching device for corns and bunions.

Corns on the little toe of a foot and bunions on the big toe of a foot are very painful when a shoe worn on the foot causes pressure on such corns and/or bunions.

The principal object of the invention is to provide a shoe stretching device of simple structure, which is used with facility and convenience to stretch the sides of a shoe to a desired extent to relieve the pressure of the shoe on corns and/or bunions.

An object of the invention is to provide a shoe stretching device which is inexpensive in manufacture, light in weight, compact in size, and transported and stored with convenience and in a minimal space.

Another object of the invention is to provide a shoe stretching device for stretching selected sides of a shoe to a selected extent rapidly and under any conditions.

BRIEF SUMMARY OF THE INVENTION

In accordance with the invention, a shoe stretching device for corns and bunions stretches a shoe having a pair of opposite sides each of which is adjacent a corresponding one of the big toe and the small toe of the foot of a wearer of the shoe. The shoe stretching device comprises a pair of stretching members each shaped to stretch a substantially concave area in a side of a shoe to relieve pressure on a corn, bunion, and the like. Manually operated moving means couples the stretching members to each other and selectively moves each of the stretching members into and away from the corresponding side of the shoe for stretching the side to a desired extent.

The moving means comprises a frame and gear means including a drive gear and driven gears rotatably mounted on the frame. A shaft is affixed at one end to and rotatable with the drive gear. A handle at the other end of the shaft rotates the drive shaft. Coupling means releasably couples each of the stretching members to a corresponding one of the driven gears for selective reciprocating movement.

The coupling means of the moving means comprises a pair of arms each pivotally eccentrically affixed at one end to a corresponding one of the driven gears. Each of a pair of adjustable coupling members is affixed to the other end of a corresponding one of the arms for removably coupling the stretching members to the arms.

Each of the coupling members comprises a support strip affixed to the corresponding one of the arms substantially perpendicularly thereto and has a plurality of spaced bores therein along its length. Each of the stretching members comprises a generally hemispherical member having a substantially planar base and a diametrically and axially extending pin-type member extending from the base for removable insertion of the stretching member in the coupling member.

BRIEF DESCRIPTION OF THE DRAWING

In order that the invention may be readily carried into effect, it will now be described with reference to the accompanying drawing, wherein:

FIG. 1 is a view of an embodiment of the shoe stretching device of the invention;

FIG. 2 is a view, taken along the lines II—II, of FIG. 1;

FIG. 3 is a view, taken along the lines III—III, of FIG. 1;

FIG. 4 is a perspective view, on an enlarged scale, of an embodiment of the stretching member of the shoe stretching device of the invention; and FIG. 5 is a view, on an enlarged scale, of an embodiment of a coupling member and a stretching member of the shoe stretching device of the invention, coupled to each other.

In the FIGS., the same components are identified by the same reference numerals.

DETAILED DESCRIPTION OF THE INVENTION

The shoe stretching device of the invention is to alleviate pressure on corns and bunions by stretching a shoe. The shoe stretching device of the invention stretches a shoe 1 having a pair of opposite sides 2 and 3 (FIG. 1). The side 2 of the shoe 1 is adjacent the big toe (not shown) of a wearer of the shoe and the side 3 is adjacent the small toe (not shown) of the foot (not shown) of the wearer.

A pair of stretching members 4 and 5 are provided. Each of the stretching members 4 and 5 is shaped to stretch a substantially concave area in the side 2 and 3, respectively, of the shoe 1 to relieve pressure on a bunion, corn, and the like.

Manually operated moving means couples the stretching members 4 and 5 to each other and selectively moves each of the stretching members into and away from the corresponding side 2 and 3 of the shoe 1 for stretching the side to a desired extent. The directions into the sides 2 and 3 of the shoe are indicated by arrows 6 and 7, respectively, and the directions away from said sides are indicated by arrows 8 and 9, respectively, in FIG. 1.

The moving means comprises a frame 10 of substantially triangular configuration (FIGS. 1 and 2). A gear device includes a drive gear 11 and driven gears 12, 13 and 42 rotatably mounted on the frame 10 (FIGS. 1 and 2). A shaft 14 is affixed at one end 15 (FIG. 1) to the drive gear 11 and is rotatable with the drive gear. A handle 16 is affixed at the other end 17 (FIG. 2) of the shaft 14 for rotating the drive gear 11.

The moving means further comprises coupling means releasably coupling each of the stretching members 4 and 5 to a corresponding one of the driven gears 12 and 42, respectively, for selective reciprocating movement in the directions of the arrows 6 and 7 and 8 and 9 (FIG. 1). The coupling means of the moving means comprises a pair of arms 18 and 19 (FIGS. 1 and 2). The arm 18 is pivotally eccentrically affixed at one end 20 to the driven gear 12. The arm 19 is pivotally eccentrically affixed at one end 21 to the driven gear 42, which is driven by the driven gear 13.

The coupling means further comprises a pair of adjustable coupling members 22 and 23 (FIGS. 1 and 2). The adjustable coupling member 22 is affixed to the other end 24 of the arm 18 for removably coupling the stretching member 4 to said arm (FIGS. 1 and 2). The adjustable coupling member 23 is affixed to the other end 25 of the arm 19 for removably coupling the stretching member 5 to said arm (FIGS. 1 and 2).

Each of the coupling members 22 and 23 comprises a support strip affixed to the corresponding one of the arms 18 and 19 substantially perpendicularly thereto and has a plurality of spaced bores therein along its length (FIGS. 1 and 3). Thus, as shown in FIG. 1, the coupling member 22 has a plurality of spaced bores 26, 27, 28 and 29 therein along its length. As shown in FIGS. 1 and 3, the coupling member 23 has a plurality of spaced bores 30, 31, 32 and 33 therein along its length.

The stretching member 4 comprises a generally hemispherical member 34 having a substantially planar base 35 and a diametrically and axially extending pin-type member 36 extending from said base for removable insertion of the stretching member in the coupling member 22 (FIG. 1). The stretching member 5 comprises a generally hemispherical member 37 having a substantially planar base 38 and a diametrically and axially extending pin-type member 39 extending from said base for removable insertion of the stretching member in the coupling member 23 (FIGS. 1, 4 and 5). An axially and diametrically extending extra hemispherical part 40 and 41, respectively, is provided on each of the hemispherical members 34 and 37, respectively, if desired. The hemispherical parts 40 and 41 are of smaller diameter than the hemispherical members 34 and 37.

While the invention has been described by means of a specific example and in a specific embodiment, I do not wish to be limited thereto, for obvious modifications will occur to those skilled in the art without departing from the spirit and scope of the invention.

I claim:

1. A shoe stretching device for corns and bunions for stretching a shoe having a pair of opposite sides each of which is adjacent a corresponding one of the big toe and the small toe of the foot of a wearer of the shoe, said shoe stretching device comprising a pair of stretching members each shaped to stretch a substantially concave area in a side of a shoe to relieve pressure on a corn, bunion, and the like; and manually operated moving means coupling the stretching members to each other and selectively moving each of the stretching members into and away from the corresponding side of the shoe for stretching the side to a desired extent, said moving means comprising a frame, gear means including a drive gear and driven gears rotatably mounted on the frame, a shaft affixed at one end to and rotatable with the drive gear, a handle at the other end of the shaft for rotating the drive gear, and coupling means releasably coupling each of the stretching members to a corresponding one of the driven gears for selective reciprocating movement, said coupling means comprising a pair of arms each pivotally eccentrically affixed at one end to a corresponding one of the driven gears, and a pair of adjustable coupling members each affixed to the other end of a corresponding one of the arms for removably coupling the stretching members to the arms.

2. A shoe stretching device as claimed in claim 1, wherein each of the coupling members comprises a support strip affixed to the corresponding one of the arms substantially perpendicularly thereto and having a plurality of spaced bores therein along its length, and each of the stretching members comprises a generally hemispherical member having a substantially planar base and a diametrically and axially extending pin-type member extending from the base for removable insertion of the stretching member in the coupling member.

* * * * *